United States Patent [19]

Lin

[11] Patent Number: 4,738,120

[45] Date of Patent: Apr. 19, 1988

[54] REFRIGERATION-TYPE DEHUMIDIFYING SYSTEM WITH ROTARY DEHUMIDIFIER

[76] Inventor: Win-Fong Lin, P.O. Box 10160, Taipei, Taiwan

[21] Appl. No.: 98,783

[22] Filed: Sep. 21, 1987

[51] Int. Cl.[4] ..... F25D 21/00

[52] U.S. Cl. ..... 62/272; 62/93; 62/285

[58] Field of Search ..... 62/272, 285, 290, 150, 62/93, 271

*Primary Examiner*—Henry A. Bennet

[57] ABSTRACT

A refrigeration-type dehumidifying system includes a rotary dehumidifier having a dehumidifying chamber, a defrost chamber and a cooling chamber radially formed within a casing and a dehumidifier wheel with plural heat-exchanger blades rotatably mounted in the casing to rotatively pass the three chambers whereby upon the counterclockwise rotation of the wheel, a dehumidifying air stream is directed into the dehumidifying chamber to deposit its lading moisture on the cooled wheel blades which in turn is defrosted when heated in the defrost chamber and further cooled in the cooling chamber to operate the dehumidification recirculatively.

3 Claims, 2 Drawing Sheets

22
221
412
411
4
41
42
421
451
32
45
452
3
51
43
44
R
11
12
C
1
441
121
31
442
124
22
21
15
b
d
33
2
13
73
52
5
a
122
12
123
S
51
82
23
131
50
e
141
14
111
72
7
f
81
8
53
6
71
54
I 132
11
R
121
134
133
13
131
122
15
12
123

REFRIGERATION-TYPE DEHUMIDIFYING SYSTEM WITH ROTARY DEHUMIDIFIER

BACKGROUND OF THE INVENTION

A conventional electrical dehumidifier is shown in FIG. 6 wherein the moisture-laden air is generally drawn into the rear of the dehumidifier and over the cold evaporator coils EC by the fan AF. As this air is cooled, some of the moisture is condensed out of it and is deposited on the coils in the same manner as moisture collects on a glass of ice water on a humid day. The drops of water which form on the coils run down and fall into the water collecting bucket WT. The cooler air with less moisture content is then passed over the warm condenser coils CC for raising its temperature to thereby get a warm, drier air.

However, if such a refrigeration-type dehumidifier is used to greatly dehumidify the moisture as laden in the air by lowering the dew point of the conditioned air below the ice point of water, the water as condensed on the evaporator coil will freeze to become ice to clog the evaporator coils to influence the dehumidification operation.

The present inventor has found the defects of such a conventional dehumidifier and invented the present dehumidifying system with rotary dehumidifier.

SUMMARY OF THE INVENTION

The object of the present invention is to provide a dehumidifying system including: a rotary dehumidifier having a dehumidifier wheel operatively rotating between a pair of trifurcate separators of which each trifurcate separator defines a dehumidifying chamber, a defrost chamber and a cooling chamber radially; a refrigerant circulator providing cooling refrigerant for a primary cooler and a secondary cooler respectively cooling a dehumidifying air stream and the dehumidifier wheel; and a defrost air supplier providing a warm air stream blowing through the defrost chamber, whereby upon the counterclockwise rotation of the dehumidifier wheel, a moisture-laden air as precooled by the primary cooler will be effectively dehumidified to deposit most of its water on the wheel when passing through the dehumidifying chamber of the wheel which is previously cooled in the cooling chamber by the air stream as cooled by the secondary cooler to lower its dew point below the ice point, and the defrost air is warmed and directed into the defrost chamber to vaporize and remove the water as previously deposited on the wheel when passing through the dehumidifying chamber, thereby forming a compact unit for economically, efficiently dehumidifying an air stream to a minimum moisture content.

DETAILED DESCRIPTION

Figure 1:
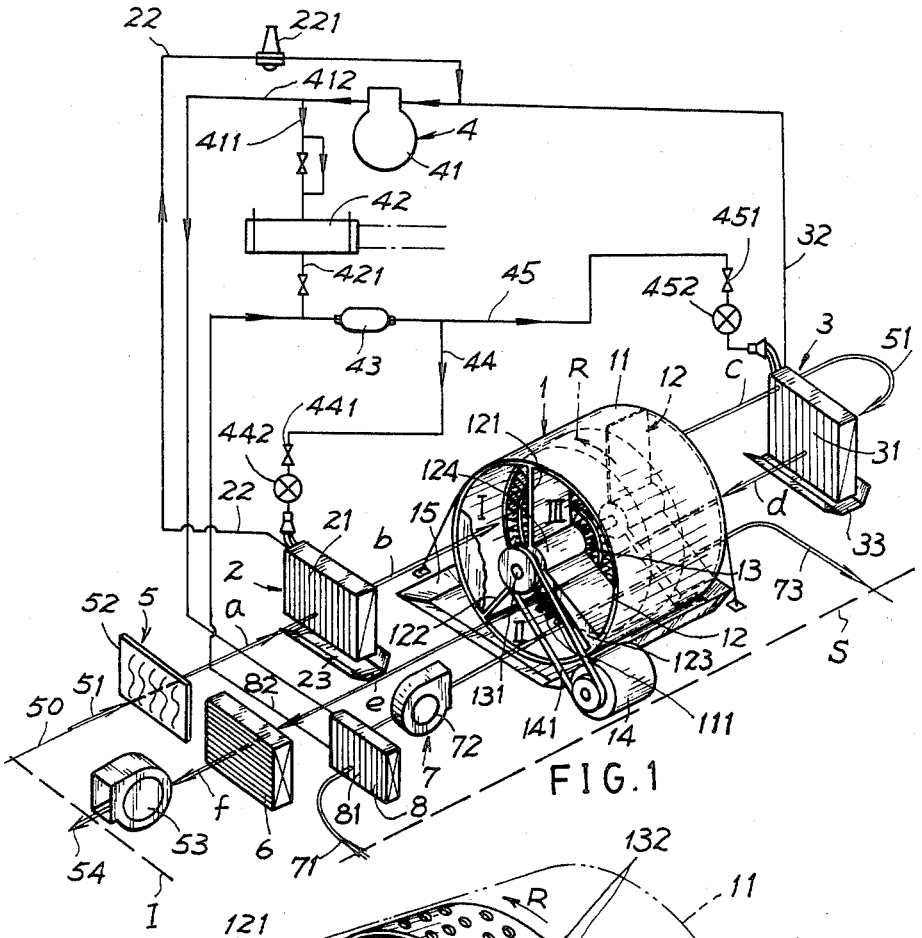
FIG. 1 is an illustration showing the present invention.

As shown in FIGS. 1–5, the present invention comprises: a rotary dehumidifier 1, a primary cooler 2, a secondary cooler 3, a refrigerant circulator 4, a dehumidifying-air circulator 5, a dehumidified-air reheater 6, a defrost-air supplier 7 and a defrost-air heater 8.

The rotary dehumidifier 1 includes: a cylindrical casing 11 having its lower periphery drilled with plural drain holes 111, a pair of trifurcate separators 12 respectively fixed in the front and the rear sides of the casing 11, a dehumidifier wheel 13 rotatably mounted between the two separators 12 within the casing 11, a driving motor 14 driving the wheel 13, and a water collector 15 positioned under the casing 11.

Each trifurcate separator 12 includes three partition plates 121, 122,123 radially protruding from a central bush 124 rotatively mounting a shaft 131 of the wheel 13. A dehumidifying chamber I is defined between the first and the second partition plates 121, 122. A defrost chamber II is defined between the second and the third partition plate 122,123. A cooling chamber III is defined between the third and the first plates 123, 121. Since there may be a larger temperature gradient between the chamber II and chamber III, the third partition plate 123 is formed with a thicker thickness as shown in FIG. 1.

Figure 2:
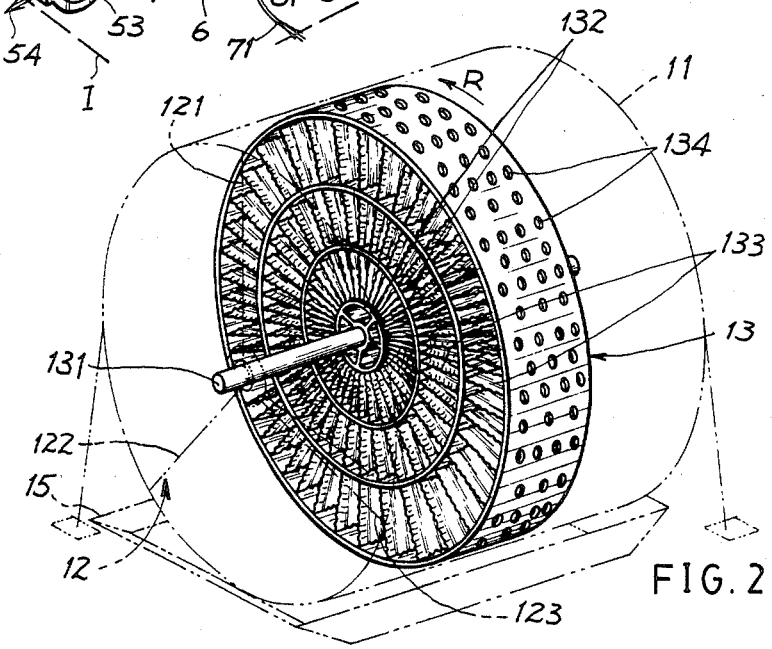
FIG. 2 is an illustration showing a dehumidifier wheel of the present invention.
Figure 3:
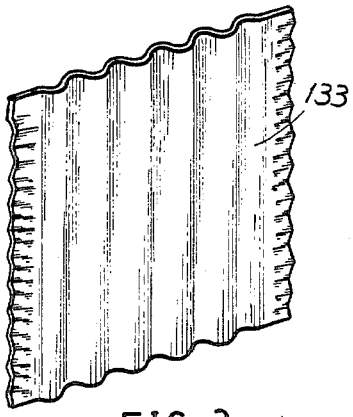
FIG. 3 shows a blade of the dehumidifier wheel of the present invention.

The dehumidifier wheel 13 as shown in FIGS. 1, 2 and 3 includes: a central shaft 131, plural concentric cylindrical plates 132 having its innermost plate secured to the shaft 131 and having each plate 132 formed with plural drain perforations 134 through each plate, and plural radial heat-exchanger blades 133 each radially secured between every two adjacent concentric plates 132. The blade 133 as shown in FIG. 3 may be formed with corrugations thereon and preferably made of heat-conductive metals. The wheel 13 is driven by the motor 14 by a transmission belt 141 coupled between the wheel shaft 131 and the motor shaft.

Figure 4:
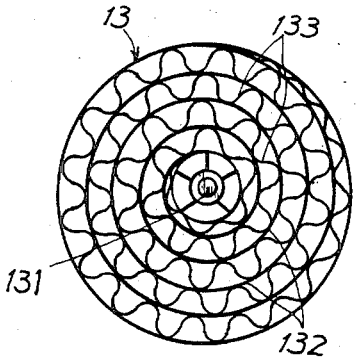
FIG. 4 shows another preferred embodiment of the dehumidifier wheel of the present invention.

Another preferred embodiment of the dehumidifier wheel 13 is shown in FIG. 4 which includes: a central shaft 131, a continuous spiral plate 132 spirally secured to the shaft 131, a continuous corrugated blade 133 circumferentially secured on the spiral plate 132 as retained between every two adjacent windings of the spiral plate 132, and plural drain perforations 134 formed on the spiral plate 132. Naturally, other types of blades 133 of the wheel may be used in this invention besides the aforementioned blades.

The refrigerant circulator 4 includes: a compressor 41 having a first discharge pipe 411 delivering the compressed refrigerant to a condenser 42 and a second discharge pipe 412 delivering the warm refrigerant to the defrost-air heater 8, a dryer 43 connected with the condenser 42 by a discharge pipe 421 and connected with the other pipe 82 from the heater 8 for filtering the refrigerant which is then directed through a front pipe 44, a first control valve 441, and a first expansion valve 442 to the primary cooler 2 and through a rear pipe 45, a second control valve 451 and a second expansion valve 452 to the secondary cooler 3.

The primary cooler 2 includes an evaporator coil 21 fluidically communicated with the first expansion valve 442 for directing the vaporizing refrigerant through the coil 21, a refrigerant return pipe 22 delivering the vaporized refrigerant through a pressure regulator 221 to a suction port of the compressor 41, and a water collecting tray 23 to collect the condensed water from the cooler 2.

The secondary cooler 3 includes an evaporator coil 31 fluidically communicated with the second expansion valve 452 for directing the vaporizing refrigerant through the coil 31, a refrigerant return pipe 32 delivering the vaporized refrigerant to the suction port of the compressor 41, and a water collecting tray 33 for collecting the condensed water from the cooler 3.

The dehumidifying-air circulator 5 includes: an air loop duct 51 having a suction port 50 communicated with a building interior I, an air filter 52 formed on the duct between the port 50 and the primary cooler 2, and an air circulating fan 53 formed on the disharge end of the duct 51 and connected with a discharge port 54 discharging the dehumidified air into the interior I. The loop duct 51 delivers the air stream rearwardly to pass through the primary cooler 2, the dehumidifying chamber I of the rotary dehumidifier 1, and then direct the air frontwardly through the secondary cooler 3, the cooling chamber III of the dehumidifier 1 and the dehumidified-air reheater 6 to the fan 53.

The defrost-air supplier 7 includes: a suction duct 71 communicated with the air in an outside environment of a drying-air source S, a blower 72 connected with the duct 71 to blow warm air into the defrost chamber II as heated by the defrost-air heater 8 formed on the duct 71 beyond the blower 72, and a discharge duct 73 discharging the moisture-contained air from the chamber II to the outside environment S.

In operating the present invention, the refrigerant circulator 4 is running to allow the primary cooler 2 cooling the air through the duct 51 as drawn by the fan 53 from a temperature ta such as 25° C. at point "a" beyond primary cooler 2 to a lower temperature tb such as 5° C. at point "b" between the cooler 2 and the dehumidifier 1 and to allow the secondary cooler 3 cooling the air through the duct to enter the cooling chamber III of the dehumidifier 1 to cool the wheel 13 which is rotated counterclockwise R as driven by motor 14 to thereby cool the air from point "b" to point "c" whereby the air temperature tc is reduced to a very low temperature such as −17.5° C. and further cooled to be a lowest td, such as −20° C. at point "d" greatly below ice point of water by the cooler 3. The frontwardly moving air after cooling the wheel 13 in chamber III will be heat-exchanged to be a warmer temperature te such as 2.5° C. at point "e" when leaving the chamber III of the dehumidifier 1. The air is then reheated by reheater 6 to be about a warm temperature tf, such as 15° C. at point "f" to be drafted into interior I by fan 53. When the moisture-laden air is led from point "a" to "b", the moisture as laden in the air whose dew point is above 5° C. will be condensed and removed from the cooler 2. The remaining major content of moisture is deposited at wheel 13 when passing through the dehumidifying (frosting) chamber I to thereby efficiently accomplish the dehumidification since the air is greatly cooled by reducing its dew point greatly below the ice point. The water (frost) as deposited on the wheel 13 is rotated (R) from chamber I to the defrost chamber II whereby the warm air as blowed by blower 72 will heat the frost in chamber II to become water as drained into collector 15 and minor water vapor which is blown off as carried by the air to discharge outwardly through duct 73. The wheel 13 is then defrosted and rotated to the cooling chamber III for next cooling operation and for recircling the rotary dehumidifier 1. The defrost-air heated 8 includes a warm refrigerant coil 81 connected with the second pipe 412 of the compressor 41 for leading warm refrigerant for the heat exhange with the inlet air from outside environment S, and a return refrigerant pipe 82 delivering the cool refrigerant to the dryer 43 to combine the liquid refrigerant from condenser 42.

Figure 5:
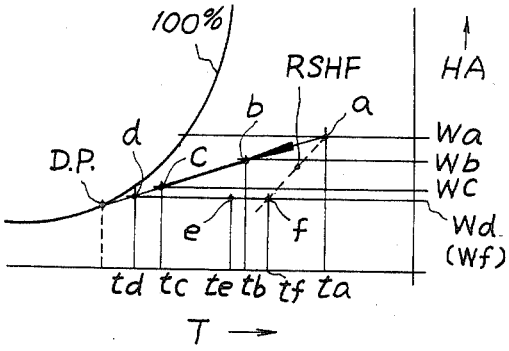
FIG. 5 is a diagram showing a psychrometric chart of absolute humidity HA versus temperature T in accordance with the present invention.
Figure 6:
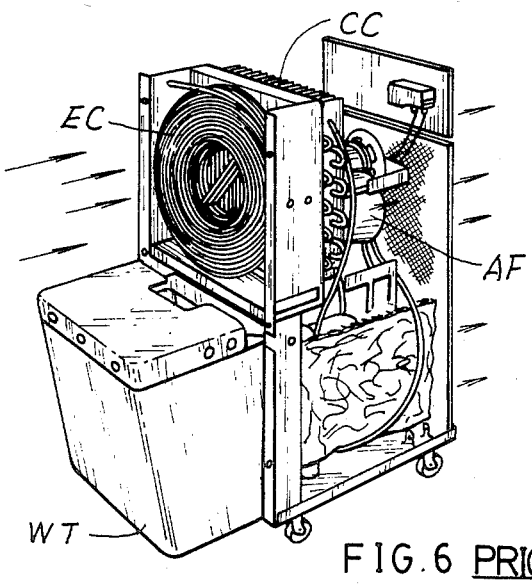
FIG.6 PRIOR ART
FIG. 6 shows a prior art of a conventional dehumidifier.

The operation of the present invention can be simply illustrated as shown in FIG. 5 wherein the starting higher temperature ta of air with high moisture content, such as Wa is dehumidified practically through the full-line path a, b, c, d, D.P. (dew point of the air stream at 100% humidity on the saturation curve), d, e, f to obtain a dehumidified air such as Wf with cool temperature tf. The dotted line RSHF simply shows the temperature difference between the interior design temperature and the conditioned (dehumidified) air temperature, which is governed by the room sensible heat factor (RSHF), versus the humidity difference Wa-Wf to indicate that the moisture content of the air is reduced and the air is dried.

The present invention is superior to any conventional refrigeration-type dehumidifier because the rotary dehumidifier 1 is rotated counterclockwise (R) to circulatively pass through a dehumidifying zone (I), a defrost zone (II) and a cooling zone (III) simply by means of the compact rotary wheel unit, but efficiently performing the dehumidification of the conditioned air even greatly under the ice point without worrying the frost clogging on the dehumidifier since the frost accumulated in chamber I will be heated and removed in chamber II.

In order to enforce the air-tightness for the operation of the rotary dehumidifier 1, several packings or sealants are provided between the wheel 13 and the trifurcate separators 12, and between the wheel 13 and the upper inside wall of casing 11.

I claim:

1. A dehumidifying system comprising:

a rotary dehumidifier radially defining a dehumidifying chamber, a defrost chamber and a cooling chamber;

a refrigerant circulator having a compressor circulating a refrigerant for cooling a primary cooler and a secondary cooler respectively cooling a dehumidifying air to lower its dew point below the ice point of water and the rotary dehumidifier;

a dehumidifying-air circulator having an air loop duct communicated with a suction port of a building interior, having said loop duct passing through an air filter, the primary cooler, the dehumidifying chamber of said rotary dehumidifier, the secondary cooler, and the cooling chamber of said dehumidifier, and a dehumidified-air reheater, and an air circulating fan connected with said loop duct having a discharge port delivering the dehumidified air into the building interior; and a defrost-air supplier having a suction duct communicated with an outside environment, an air blower blowing a warm air as heated by a defrost-air heater formed on the suction duct into the defrost chamber of said dehumidifier, and a discharge duct for outwardly discharging the water vapor as carried by the air from the defrost chamber;

the improvement which comprises: said rotary dehumidifier including: a cylindrical casing having its lower periphery drilled with plural drain holes, a pair of trifurcate separators respectively fixed in the front side and rear side of said casing each trifurcate separator having three radial partition plates protruding from a central bush rotatably mounted with a shaft of a dehumidifier wheel to define the dehumidifying chamber, the defrost chamber and the cooling chamber within said casing, the dehumidifier wheel with plural heat-exchanger blades formed therein rotatably mounted between said two trifurcate separators and driven by a driving motor, and a water collector positioned under said casing, whereby upon the rotation of said dehumidifier wheel counterclockwise, said wheel having its blades cooled in the cooling chamber is rotated into the dehumidifying chamber to cool the air stream passing therethrough to dehumidify the air and deposit the moisture as laden in the air on the wheel which in turn is defrosted in the defrost chamber when further rotating said wheel into said defrost chamber.

2. A dehumidifying system according to claim 1, wherein said dehumidifier wheel includes a central shaft rotatably mounted in said trifurcate separators, plural concentric cylindrical plates having its innermost plate secured to said central shaft and having each said plate formed with plural drain perforations therethrough, and plural radial heat-exchanger blades each secured between every two adjacent concentric plates.

3. A dehumidifying system according to claim 1, wherein said dehumidifier wheel includes: a central shaft rotatably mounted in said trifurcate separators, a continuous spiral plate having plural drain perforations formed therethrough spirally secured to said central shaft, and a continuous corrugated blade circumferentially secured on said spiral plate as retained between every two adjacent windings of said spiral plate.

* * * * *